United States Patent [19]

Bunyea

[11] Patent Number: 4,731,766

[45] Date of Patent: Mar. 15, 1988

[54] COMBINATION SKI POLE HANDLE WITH HAND-OPERATED WATCH OR TIMING DEVICE MOUNTED THEREIN

[76] Inventor: Jeffrey M. Bunyea, 7925 Modesto Dr., Riverside, Calif. 92503

[21] Appl. No.: 882,284

[22] Filed: Jul. 7, 1986

[51] Int. Cl.[4] ..... G04B 47/00; A63C 17/26

[52] U.S. Cl. ..... 368/10; 368/110; 280/816; 280/819

[58] Field of Search ..... 368/10, 107, 113, 276, 368/278; 280/809, 816, 819

[56] References Cited

U.S. PATENT DOCUMENTS 4,082,302 4/1978 Albrecht ..... 280/11.37 H
4,111,444 9/1978 Clements, Jr. ..... 280/11.37 E
4,445,786 5/1984 Jackson ..... 368/10

FOREIGN PATENT DOCUMENTS 2044494 10/1980 United Kingdom .

*Primary Examiner*—Vit W. Miska

[57] ABSTRACT

A combination ski pole handle with a hand-operated watch or timing device mounted therein is disclosed, including a molded hand grip for mounting on the top end of a ski pole, a watch protectively mounted within the hand grip thereof and disposed on a rearwardly sloping top portion thereof to be easily viewable by the skier with the ski pole disposed in near vertical fashion which includes a timing function, and a finger-actuated trigger mechanism for controlling the timing function of the watch.

15 Claims, 3 Drawing Figures

COMBINATION SKI POLE HANDLE WITH HAND-OPERATED WATCH OR TIMING DEVICE MOUNTED THEREIN

BACKGROUND OF THE INVENTION

1. Field of the Invention

The present invention lies in the field of sports' equipment which includes a combination watch and timing device, and, more particularly, to ski poles incorporating such a watch or timing device in the handle thereof.

2. Description of the Prior Art

The prior art includes may different types of sporting gear and equipment which comprise a combination of the sporting equipment and a watch and/or timing device.

One such prior art device is shown and illustrated in U.S. Pat. No. 4,445,786 issued to Jackson on May 1, 1984 which relates to an elapsed time rod and reel apparatus. Such an apparatus provides a convenient means for accurately recording elapsed time between the catching of a fish and the landing of same. This is relatively important in determining the size of the fish on the other end of the line, and for later relating in a proverbial "fish story".

Only two other attempts are known to incorporate a watch and/or timing device in a ski pole handle.

One such attempt is related in the German Pat. No. 180,027 issued Oct. 25, 1954 incorporates a rubber body 2 which includes a receptacle used for elastically mounting the rubber body 2 to the top portion 3 of a ski pole handle 4, a receptacle for receiving a timing device, such as a stop watch 1, and a tether 5 which is used to secure the rubber body 2 to the ski pole handle 4. This invention is simply a holding structure for the stopwatch 1 in position on top 3 of the ski pole handle 4. It does not provide an means for activating or stopping the stopwatch 1 with a minimum of finger movement on the part of the skier and because of the manner in which this invention is constructed it is impossible to operate the timing device without removing a finger from the ski pole handle for the purpose of operating the timing control button on the top of the watch. Further, in the event that the skier should go down, it is clearly anticipated that the rubber body 2 will become disengaged from the top 3 of the ski pole handle 4 because of the existence of a tether 5. Still further, this device does not in any way attempt to incorporate this into the hand grip which is disposed about the handle portion 4 of the ski pole.

The only other device to incorporate a timing device 3 into the handle 1 of a ski pole is that which is shown in U.S. Pat. No. 4,082,302 issued to Albrecht on Apr. 4, 1978. Basically, this device includes a chronometer 3 removeably mounted on the top of a ski pole handle 1 by way of a bayonet fitting which so arranges the push button 4 of the stopwatch 3 so that it can be easily actuated by the skier's thumb. However, it would be nearly impossible for this to be actuated by a finger of the skier. Such also provides for an unnecessary protrusion, that is, the push button 4, on the ski pole handle 1 which may be ripped or torn off if the skier goes down during a ski run.

Further, in the prior art shown in U.S. Pat. No. 4,082,302, the viewing position of the face of the stopwatch is so configured that it cannot be easily or readily viewed when the ski pole is disposed vertically in its normal position unless the top of the ski pole is disposed substantially beneath the eye level of the skier which is not usually the case. The present invention eliminates this highly irregular feature by disposing the face of the stopwatch on a rearwardly sloping portion of the mounting in the ski grip handle so that when the ski pole is vertically disposed, the stopwatch face can be readily and easily viewed by the skier.

With any stopwatch controls unprotected, as displayed in the prior art illustrated by the device of U.S. Pat. No. 4,082,302, the stopwatch timing control function can be inadvertently activated since it is not protected because it envisions external activation by the skier's thumb. The stopwatch timing control of the instant invention described further herein is protected and cannot be inadvertently activated. Such a feature is greatly desired for timing skiing runs.

It is because of these many problems found in the prior art and the wide spread desire and need for skiers to measure both the times and durations of their ski runs for the purpose of both monitoring their improvement and location that the present invention was created.

SUMMARY OF THE INVENTION AND OBJECTS

Basically, the present invention is a combination ski pole handle with a hand-operated stopwatch or timing device mounted therein is disclosed, including a molded hand grip for mounting on the top end of a ski pole, a watch protectively mounted within the hand grip thereof and disposed on a rearwardly sloping top portion thereof to be easily viewable by the skier with the ski pole disposed in near vertical fashion which includes a timing function, and a finger-actuated trigger mechanism for controlling the timing function of the watch.

With a conventional stopwatch, a skier is not able to control his travelling time accurately, since simultaneously actuating a wrist-mounted stopwatch and pushing off with ski poles is not possible. Hence, a finger-actuated and controlled stopwatch mechanism is highly desireable.

Further, it is nearly impossible, or certainly possible with only substantial difficulty, to determine the times of certain sections of a ski run during the actual process of skiing. As a result, an associate is usually used and required.

Therefore, it is one object of the instant invention to provide for a stopwatch and ski handle grip combination which permits a time check of any portion of the ski run at any time.

It is another important and primary object of the present invention to provide for a combination timing device and ski pole handle grip which permits the skier to accurately manipulate with a single finger movement the timing function of the stopwatch by moving the finger slightly upwardly and inwardly during the process of skiing.

Another equally important and significant object of the present invention disclosed herein is to provide for an improved combination ski pole handle grip and stopwatch which integrally incorporates a finger-actuated stopwatch triggering mechanism.

A yet still further important and primary object of the invention disclosed and discussion herein is to provide for a combination ski pole handle grip and stopwatch which will not normally become disengaged from the ski pole if the skier should fall down during the process of a ski run.

Another important and primary object of the invention is to provide a spring-loaded, finger-actuated triggering-mechanism which includes a trigger limit stop as an integral part of the ski pole handle grip thereby capturing the trigger and preventing it from being displaced beyond its normal operating range.

It is a yet still further primary and important object of the present invention to provide for an integral ski pole handle grip which is so contoured that the skier can positively "feel" the location of the triggering section with his finger while the skier is skiing so that the skier is fully advised of the fact that his finger is in the appropriate position for either activating or de-activating the stopwatch via the spring-loaded triggering mechanism.

Another primary object of the present invention is to provide an integrated stopwatch and molded ski pole handle which is visually accessible to the skier when the ski pole is vertically disposed.

It is a yet still further object of the instant invention to provide for an integrated stop watch and molded ski pole handle which incorporates a stop watch control function which may be readily operable using the gloved finger of the skier during or after the skiing activity.

One preferred embodiment of the present invention is described below by way of example, with reference to the accompanying drawings, in which:

DESCRIPTION OF THE PREFERRED EMBODIMENT OF THE INVENTION

Figure 1:
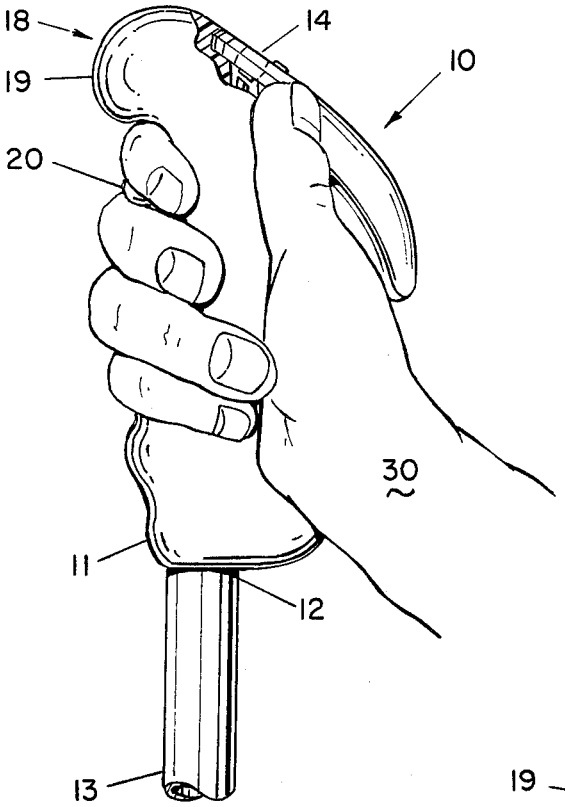
FIG. 1 is a side elevational view of the invention disclosed and described herein showing the skier's hand gripping the handle grip with the finger shown in the trigger operating position about the ski pole handle grip.

With continuing reference now to all of the Drawings herein, and with specific emphasis now on FIG. 1, there is shown the present invention, an improved combination molded ski pole handle with a finger controlled stopwatch or timing device, all generally indicated at 10, which is mounted therein and thereon on the end of a ski pole 13, including a molded ski handle grip 11 for mounting on the top end 12 of a ski pole 13, a stopwatch 14 which includes a timing function, and a spring-biased, finger-actuated mechanism 15, generally indicated at 15, for controlling the timing function of the stopwatch 14.

It should be noted at this time that typically, the molded handle grip 11 is formed of an elastomeric substance such as rubber, vinyl, or other semi-hard, but resilient, plastic material.

The elemental protrusions or arms 16, 17 are commonly found on a molded ski handle grip 11 and serve to inform the skier of precisely where his or her hand 30 is positionally located with respect to the proper orientation relative to the ski pole 13. This, of course, also allows the skier to properly maintain the stopwatch 14 in position for the correct viewing angle and orientation to allow the skier to read the stopwatch 14. Consequently, it is no longer necessary to provide for, or include, a means for interlocking the ski pole handle grip 11 with respect to the top of the ski pole such as is envisioned and set forth in U.S. Pat. No. 4,082,302.

Prior art units such as shown and detailed in U.S. Pat. No. 4,082,302 permitted the stopwatch to be actuated by the skier's thumb rather than by a gloved finger. Actuation by a finger is more desirable because it is more natural to the skier and convenient and involves substantially fewer operating problems and reduces the effort needed in the control and operation of the stopwatch. Additionally, because of the operational speed differential, it is believed and, certainly should be anticipated, that the accuracy and precision will be substantially over the thumb-operated method.

Figure 2:
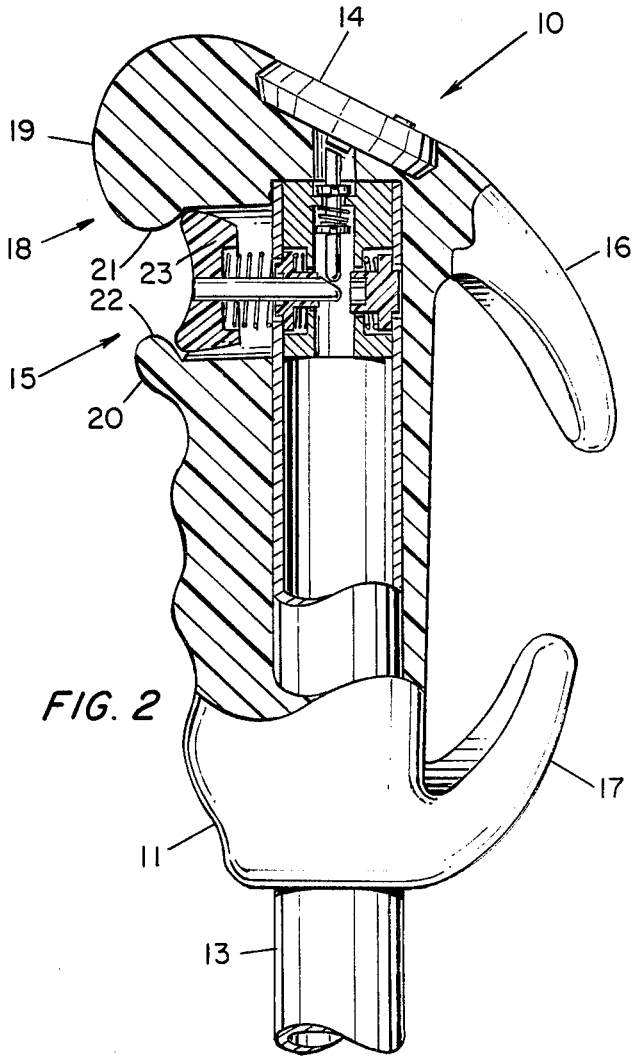
FIG. 2 is a side elevational view, shown partially in section, of the ski pole handle grip, the ski pole, and the internal mechanism of the invention.

With special emphasis now on FIG. 2, there is shown a larger view of the invention 10 disclosed herein, shown partially in section, the front molded portion of the molded ski pole handle grip 11, generally indicated at 18, the front molded portion 18 primarly including a pair of contoured portions 19, 20 which act to perform at least two important functions relative to the operation of the present invention herein. The first important function is to act as a limit stops at portions 21, 22 for the finger actuated trigger 15 to prevent the spring-biased trigger 23 from being forced beyond its mounting seat which would, of course, cause it to become disengaged from its mounting position. The second function of these two contoured portions 21, 22 is to provide a contoured arrangement to permit the skier's gloved finger to positively distinguish the location and placement of the trigger 23 during the skier's downhill dash so that he or she may be able to precisely and accurately locate and activate the trigger 23 and its related mechanism to control the stopwatch's 14 timing functions.

Figure 3:
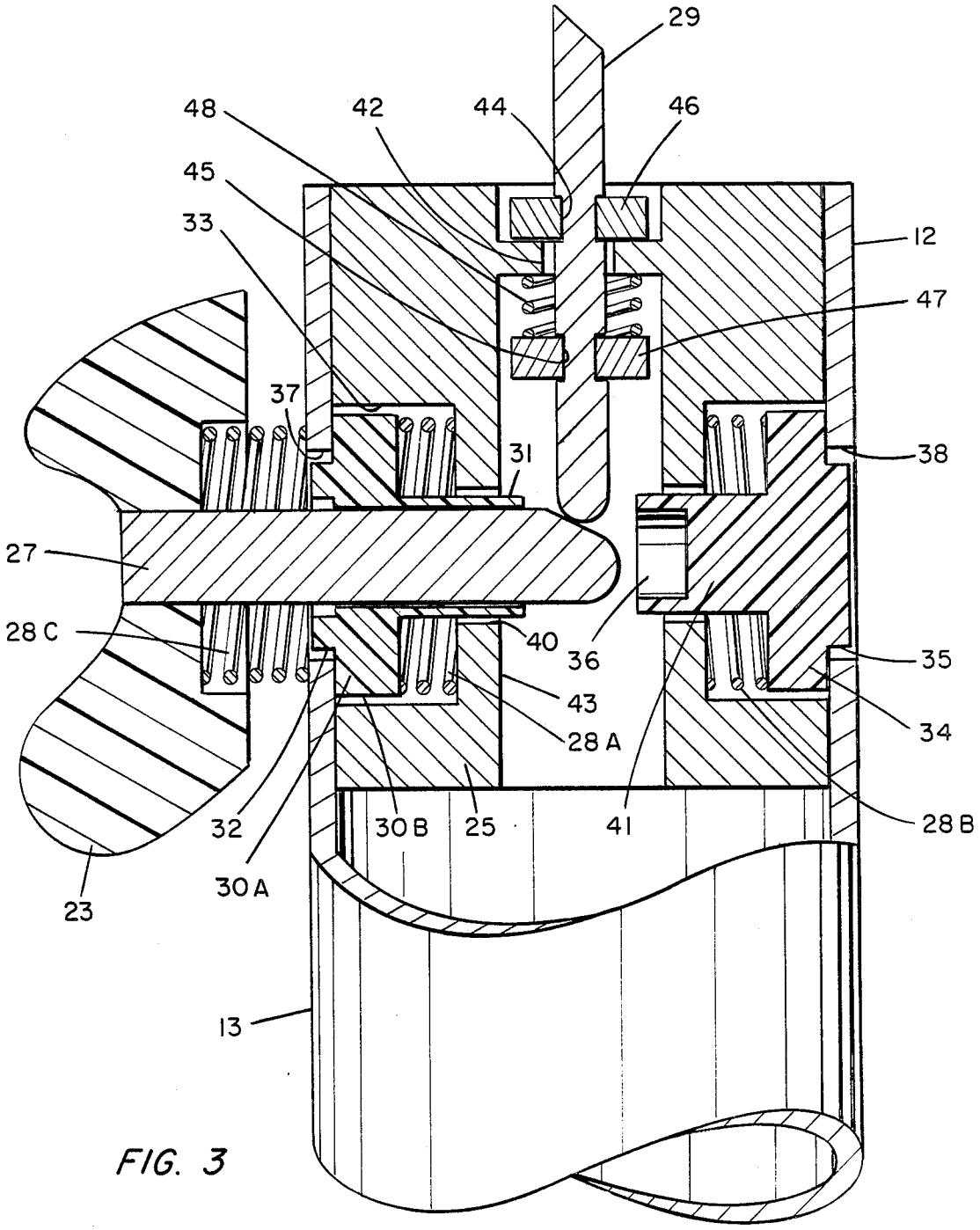
FIG. 3 is an enlarged portion of the internal mechanism of the inventon detailing how the triggering mechanism activates the stopwatch timing control pushbutton.

With primary attention now on FIG. 3, there is shown a cylindrical plug-like body 25 having dual-diametered portions therein, one of which is smaller than the other diametered portion; the smaller diametered portion being identified at 42; the larger at 43, and is adapted to be intimately mated within the top 12 of the cylindrical ski pole 13. Disposed within that body 25 is first cylindrical element 30A with a flange 30B, a narrow cylindrical tube 31, and a circular raised portion 32 which is adapted to be lockably mated with the hole 33 of the dual-diametered receptacle in the ski pole 13; the larger diametered portion being identified at 33 which the smaller diametered portion being identified at 40. A second body 41, formed as a cylindrical element which is similar to the first body 30A with a flange 34, a narrow cylindrical tube 36, and a circular raised portion 35. A pair of compression springs 28A and 28B are respectively arranged to bias the pair of cylindrically shaped first and second bodies 30A, 41 outwardly away from the center of the ski pole 13 into the oppositely-disposed pair of apertures 37, 38. With such biasing action, the first and second bodies 30A, 41 become lockably disposed therein when the combination of the spring-biased bodies 30A, 41 and the plug-like body 25 is slideably inserted into the end of the tubular ski pole 13 and as the combination is further moved into the ski pole 13, the circular raised portions 32, 35 are respectively aligned with the pair of oppositely-disposed pair of apertures 37, 38 in the ski pole 13. Once this position is obtained, the biasing force of the compression springs 28A, 28B respectively force the circular raised portions 32, 35 into the apertures 37, 38, thereby locking the entire combination into a relatively fixed position with respect to the ski pole 13.

A transversely-disposed rod 27 which is spring-biased outwardly by a spring 28C. A pin 29 which is longitudinally arranged and vertically disposed relative to the transversely-disposed rod 27 is also spring-biased to operably position one end of the pin 29 into operable engagement with the end of the transversely-disposed rod 27. The other end of the vertically-disposed pin 29 is operably engaged with the external, manually operable timing function control (not shown) of the stopwatch 14.

With this positive arrangement, the finger-actuated trigger control mechanism can be effectively disposed so as to eliminate an distorting movements which might caus the stopwatch control mechanism to malfunction.

A hollow rod guide is formed by a second, smaller diametered portion identified at 36 is provided for the other end of the transversely-disposed rod 27 so that when the transverse rod 27 is actuated by depressing the spring-biased, finger-actuated trigger 23 mechanism inwardly, the operative alignment of the transversely-disposed rod 27 is maintained with respect to the stopwatch timing control elements (not shown) to ensure operative alignment between the transversely-disposed rod 27 relative to the vertically-disposed pin 29 which is arranged to directly engaged the timing control pushbutton (not shown) of the stopwatch 14.

The trigger 23 is intended to be recessed as shown into the ski pole handle grip 11 in a manner such as will not promote accidental activation the stopwatch 14. Further, it is desired and certainly intended that the stopwatch control pushbutton should not protrude from the stopwatch 14 in such a manner so as to cause injury or damage to the stopwatch equipment or to the skier.

The trigger 23 is also arranged to provide a unique locational position and present a very distinctive feel to the skier's gloved finger which is used to actuate the trigger 23 mechanism.

In short, if the stopwatch 14 was to be actuated in any other fashion or manner, it would be inferior because the skier would be forced to move his or her hand and/or finger position drastically. Such drastic movement would cause a disturbance in both timing and accuracy of the stopwatch actuation.

If, for example, a timing control function push button (not shown) were to protrude from the face of the stopwatch 14, it would be virtually impossible for the skier to actuate it using his or her gloved finger during a ski run because the skier would be forced to move his or her hand away from its positive grip on the molded ski handle 11. Such action is highly undesirable, and, in certain cases, unsafe as well.

Further, it should be noted that the trigger 23 could be easily used to activate a light source for illuminating the face of the stopwatch 14; in fact, such a feature is frequently incorporated in many of the modernly produced digital stopwatches.

The vertically-arranged pin 29 is captively maintained in the smaller diametered portion 42 of the body 25 which serves to act as a guide for the pin 29. A pair of circular clips 46 and 47, which are frequently referred to as "snap rings" or "keeper clips", are mounted in grooves 44, 45 about the pin 29. A compression spring 48 is mounted between the snap ring 47 and the flanged surface formed by the reduced diametered portion 42 of the body 25 to bias the pin 29 in a downwardly fashion to maintain continued engagement with the end of the rod 27.

OPERATION OF THE INVENTION

As the skier commences his or her ski run, the gloved finger first quickly references the trigger's location by moving the forefinger upwardly until it finds the two contoured portions 19, 20 of the molded ski handle 11, and once found, positions his or her finger thereinbetween and depresses the trigger 23. The rod 27 which is operatively secured to the trigger 23 is forced inwardly against the spring 28C, and the opposite end of the rod 27 which is not secured to the trigger 23 is moved towards the receptacle 36 of the second cylindrical body 41. Alignment of the rod 27 is maintained with respect to receptacle 36 by the first cylindrical element's narrow tube 31 which guides the rod 27 during its actuation.

At the same time, the free end of the rod 27 has an angled surface which causes the pin 29 to be moved upwardly into engagement with the stopwatch push button (not shown) thereby actuating the timing control function of the stopwatch 14.

When the skiing run is completed, the skier depresses the trigger 23 again, thereby stopping the timing function. The stopwatch 14 will now display the elapsed time of the ski run.

Other types of closures and housings are possible, and the selection of the particular embodiment of the stopwatch 14 is not intended to be limited to that configuration which is shown and illustrated herein. More particularly, it is quite conceivable that the stopwatch 14 may be configured with additional pushbuttons, and it is not necessary for all of the parts to be made of plastic material, other materials such as, for example, metal or metal and leather or synthetic leather are clearly possible.

What I claim as my invention is:

1. A combination ski pole with a molded hand grip for mounting on the top end of the ski pole with a finger-operable timing function therein, comprising:

(a) stop watch means incorporating a timing function with an external, manually-operable control means, said control means being operably disposed below said stop watch means, said stop watch means being operably disposed and protectively mounted in the uppermost portion of the molded hand grip and exposed for ready visual readout by the skier;

(b) a finger-operable trigger means operably disposed in the molded hand grip and protectively mounted therein; and (c) mechanical means secured to the ski pole for operatively linking the watch to the trigger means, whereby when the trigger means is actuated by the skier's finger, the mechanical means is actuated for controlling the timing function of the stop-watch timing function as desired by the skier.

2. The combination of claim 1 further including biasing means for the trigger means whereby the trigger means is outwardly biased away from the ski pole.

3. The combination of claim 2 wherein said biasing means is a spring biasing means.

4. The combination of claim 2 wherein said molded hand grip includes a stop limit means for preventing the biased trigger means from traveling therebeyond.

5. The combination of claim 1 wherein said stopwatch means includes an hour of the day function.

6. The combination of claim 1 wherein said stopwatch means is operably mounted on the molded ski pole hand grip at an operable viewing angle for the skier when the ski pole is disposed in a near parallel relationship with respect to the skier's body.

7. The combination of claim 1 wherein the mechanical means is operably disposed within the ski pole.

8. A combination ski pole with a molded hand grip for mounting on the top end of the ski pole with a finger-operable timing function therein, comprising:

(a) stop watch means incorporating a timing function with an external, manually-operable control means, said stop watch means being operably disposed and protectively mounted in the upper portion of the molded hand grip;

(b) a finger-operable trigger means operably disposed in the molded hand grip and protectively mounted therein;

(c) mechanical means secured to the ski-pole for operatively linking the watch to the trigger means, whereby when the trigger means is actuated by the skier's finger, the mechanical means is actuated for controlling the timing function of the stop-watch timing function as desired by the skier, a transversely arranged rod adapted for lateral movement within the ski pole, said transversely arranged rod being operably engaged at one of its ends with the trigger means; and a longitudinally arranged pin adapted for longitudinal movement within the ski pole, said longitudinally arranged pin being operably engaged at one of its ends with the other end of the transversely arranged rod and operably engaged at the other end with the external manually operable timing function control means of the the stop watch means, so that when said transverse rod is actuated by the triggering means, the transverse rod moves the longitudinal pin upwardly causing said longitudinal pin to actuate the timing function of the stop watch means.

9. The combination of claim 8 wherein the transversely arranged rod and the longitudinally arranged pin are both spring biased.

10. The combination of claim 9 further comprising a spring-biased receptacle for receiving the end of the transversely arranged rod in the event that it should travel beyond the longitudinally arranged pin to maintain operative alignment therebetween.

11. The combination of claim 8 further comprising:

(a) a hollow ski pole handle with a pair of oppositely-disposed apertures therein disposed adjacent to the upper end thereof;

said mechanical means further including:

a cylindrical body, the outer diameter of which is smaller than the inside diameter of the ski pole, said cylindrical body having a pair of oppositely-disposed, dual-diametered receptacles therein, the central portion of which extends into the central open portion of this cylindrical body, and further having a reduced diametered portion near one end of the cylindrical body;

first guide means for said transversely-arranged rod, said guide means having an aperture therethrough wherein said rod is slideably disposed therethrough, said guide means having a triple diametered portion thereabout, wherein the smallest diametered portion is operably disposed within the smaller diametered portion of one of the dual-diametered receptacles within the ski pole;

a first compression spring biasing means operably disposed between the bottom of the larger diametered portion of the dual-diametered receptacle wherein said rod is disposed, and the flange surface formed by the largest diametered portion of the guide means;

second guide means for said transversely-arranged rod, said second guide means having an aperture therein alignably disposed opposite said aperture of said first guide means, and further having a triple diametered portion thereabout, wherein the smallest diametered portion of the other one of the two dual-diametered receptacles within the ski pole;

a second compression spring biasing means operably disposed between the bottom of the larger diamtered portion o the other of said dual-diametered receptacle wherein said rod is sometimes disposed, and the flange surface formed by the largest diametered portion of the guide means;

said longitudinally arranged pin, being adapted to move reciprocally within said smaller diametered portion of said cylindrical body, one end of said pin being operably engageable with said externally manually operable timing function control means of the stop watch means, the other end of said pin being operably engageable with said transversely-arranged rod such that said pin is caused to move into operable engagement with said externally manually operable timing function control means of the stop watch means;

stop limit means for capturing said pin in said smaller diametered portion of said cylindrical body; and compression spring biasing means operably disposed about said pin to bias said pin towards said transversely-arranged rod to ensure operable engagement therewith when said transversely-arranged rod is moved by said triggering means.

12. The combination of claim 11 further comprising:

(a) spring biasing means for said triggering means; and (b) stop limit means for said triggering means to limit the travel of the spring biased triggering means.

13. The combination of claim 11 further including:

(a) spring biasing means for biasing said intermediately diametered portion of said first guide means outwardly and disposing said intermediately diametered portion into one of the oppositely-disposed apertures in said hollow ski pole handle; and (b) spring biasing means for biasing said intermediately diametered portion of said second guide means outwardly and disposing said intermediately diametered portion into the other one of said oppositely-disposed apertures in said hollow ski pole handle.

14. The combination of claim 13 wherein said triggering means is secured to the outwardly facing end of the transversely-arranged rod.

15. The combination of claim 8, wherein said stopwatch is mounted on a rearwardly-sloping portion of the ski pole handle so that when the ski pole is vertically disposed the face of the stopwatch is visually accessible to the skier.

* * * * *